United States Patent [19]

Johnson, Jr. et al.

[11] Patent Number: 4,635,895

[45] Date of Patent: Jan. 13, 1987

[54] CONCRETE FORM SPREADER BRACKET

[76] Inventors: Edward C. Johnson, Jr.; Leroy M. Johnson, both of 4987 Vanden Rd., Vacaville, Calif. 95688; Kevin Jewison, 1309 Phillip Way, Suisun City, Calif. 94585

[21] Appl. No.: 720,513

[22] Filed: Apr. 5, 1985

[51] Int. Cl.[4] ..... E01C 19/50; E04G 13/00

[52] U.S. Cl. ..... 249/5; 249/13; 249/14; 249/208; 249/216; 249/219 R

[58] Field of Search ..... 249/2, 3, 4, 5, 8, 14, 249/208, 215, 216, 219 R, 45, 13, 34

[56] References Cited

U.S. PATENT DOCUMENTS

| | | | |
|---|---|---|---|
| 2,129,208 | 9/1938 | Forbes | 249/8 |
| 2,908,959 | 10/1959 | Hogan et al. | 249/208 |
| 3,438,664 | 4/1969 | Meyer | 249/219 R |
| 3,452,960 | 7/1969 | Bowden | 249/219 R |
| 4,494,725 | 1/1985 | Sims | 249/219 R |

*Primary Examiner*—Jay H. Woo
*Assistant Examiner*—James C. Housel
*Attorney, Agent, or Firm*—Bielen and Peterson

[57] ABSTRACT

A spreader bracket for positioning concrete forms for concrete foundations, particularly the stem wall of a housing foundation. The spreader bracket is fabricated in the fashion of a strut to elevationally support and space an inner form member from an outer form member, the strut being fastened to the outer form member and its associated stake bracing to permit the inner form member to be properly supported above a slab bed, and to be easily removed after initial set of the concrete pour with minimal damage to the slab and stem wall.

10 Claims, 4 Drawing Figures

CONCRETE FORM SPREADER BRACKET

BACKGROUND OF THE INVENTION

This invention relates to a spreader bracket for concrete forms. In particular the spreader bracket not only positions the inner form from the outer form but elevates the inner form from the bed of a floor slab that is integrally poured with a perimeter stem wall in a foundation for structures such as housing.

Heretofore the inner form of a foundation wall has been conventionally supported by vertical stakes that were driven into the ground through what became the base slab for a continuously poured floor slab and perimeter stem wall foundation. In addition to the stake hole through the slab and underlying vapor barrier, the inner stakes often become difficult to remove and occasionally cause chipping of the adjacent surface of the slab on forced removal of the stakes from the set but uncured concrete slab. While the resulting hole and chipped surface can be patched with the expenditure of additional labor time, the patched square hole is structurally weak and may become a focal point for slab cracks to develop. The use of stakes for the inside form also results in an obstacle for tamping the concrete resulting in weak spots. Additionally, the stakes interfere with finishing the concrete surface adjacent the form. These inconveniences and problems coupled with the lengthy time required to set up and take down conventional forms make welcome any labor and material saving devices which result in a structurally and visually improved product.

SUMMARY OF THE INVENTION

The spreader bracket of this invention is utilized in concrete forms, particularly with respect to a foundation stem wall that is integrally poured with the pad or floor slab. In such continuous pour foundations it is desirable to permit the poured concrete to freely and continuously flow between the stem wall and the contained slab for maximum strength and resistence to cracks. Because the outer and inner edge forms for the wall section of the perimeter stem wall must be positioned above the footing trench and slab base for a combined floor slab and perimeter foundation having a raised sill, means must be provided to elevate the edge forms and properly space them from one another. While conventional vertical staking is adequate for the outside form, use of vertical stakes for the inside form is undesirable as the stakes must penetrate the vapor barrier and whatever pad insulation that may also be used. The stakes also create a sizeable hole in what is to become the floor slab. The devised spreader bracket both positions the inside form above the slab base at the level of the proposed slab surface and spaces the inside form the proper distance from the outside form for a uniformly thick stem wall.

The spreader bracket is fabricated as a support strut with a horizontal segment for supporting the inner form member, a vertical segment for spacing and orienting the inner form member, and a diagonal brace segment for supporting and stabilizing the vertical and horizontal segments. The horizontal segment has an end that is connected to the outer form and the diagonal member has an end that is connected to the component stakes for the outer form. The spreader bracket is conveniently fabricated from steel rod bent to the required configuration, or alternately molded or extruded from plastic.

The bracket is designed to be easily detached from the outer form and stake for quick and convenient removal of the inner form to permit convenient and early finishing of the perimeter of the poured slab.

While the bracket was primarily designed for a combined foundation and floor slab having a raised sill, the bracket is useful for curb and apron structures for strut and sidewall application, and other structures where it is desirable to have an elongated unitary step structure. These and other features of the invention will become apparent from a detailed description of the preferred embodiments.

DETAILED DESCRIPTION OF THE PREFERRED EMBODIMENTS

Figure 1:
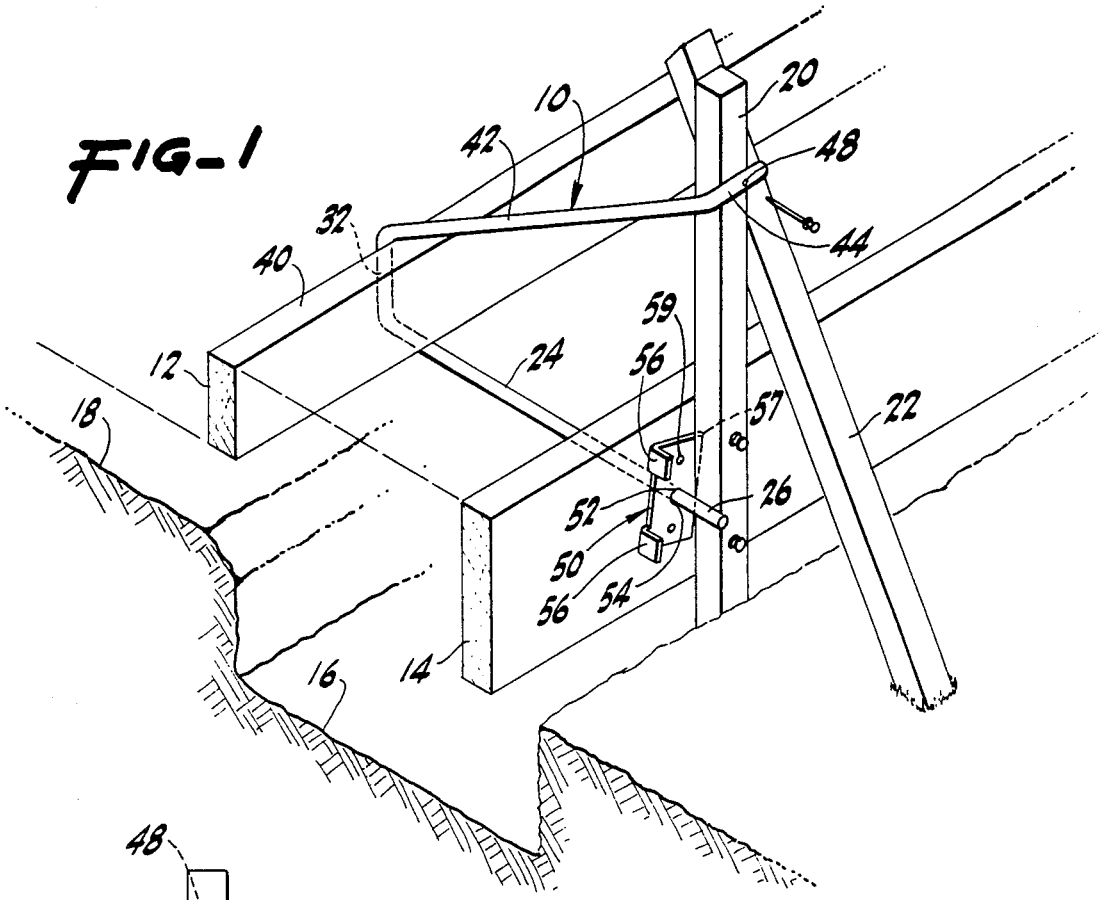
FIG. 1 is a perspective view of the concrete form and spreader bracket.
Figure 2:
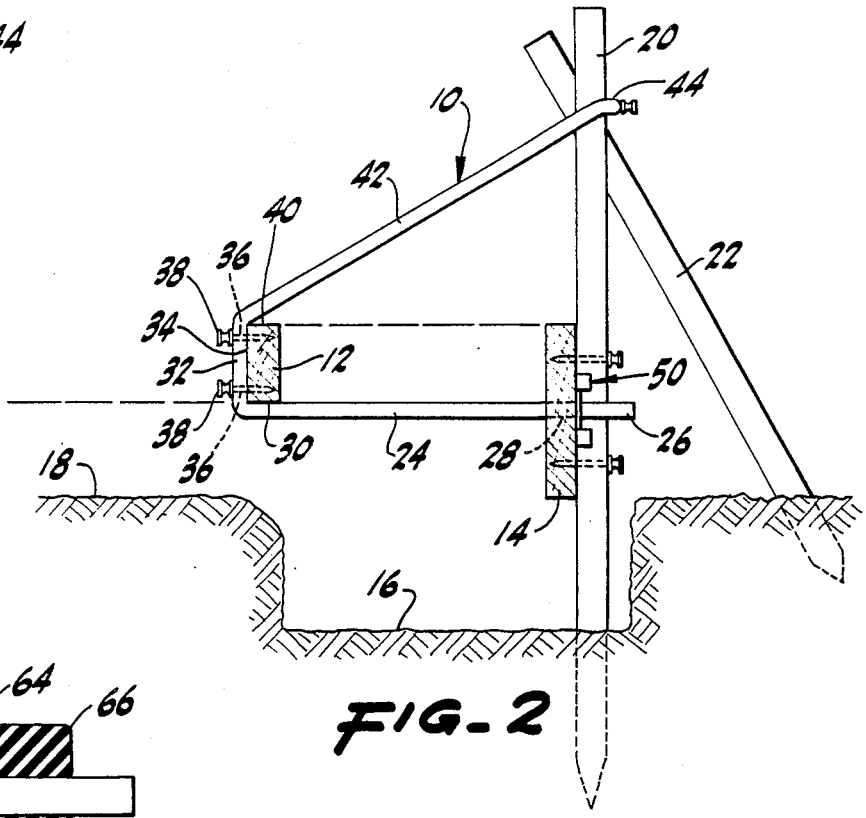
FIG. 2 is a cross sectional view of the concrete form and spreader bracket.

The spreader bracket of this invention is designated generally by the reference numeral 10 as shown in the perspective view of FIG. 1 in use in a foundation form prepatory to a pour of concrete for a unitary stem wall and slab for a structure. The spreader bracket is used in multiples to spacially support an inner form member 12 from an outer form member 14. With reference also, to FIG. 2, the inner form member 12 is supported over the ground excavation for a footing trench 16 and a slab base 18. The top surface of the prospective slab and stem wall is shown in broken line in the cross sectional view of FIG. 2.

The combined slab and perimeter foundation wall of the type shown is an efficient design for housing and other structures having a ground floor set directly on a prepared ground surface. The slab and perimeter wall is formed by a single continuous concrete pour which maximizes the strength of the overall foundation pad and eliminates seams and joints which may allow for seepage of water from under the pad. Where the combined slab and foundation wall is to include an integral elevated sill, it is necessary to include an inner form member as well as an outer form member to contain the concrete forming the elevated or raised sill. The spreader bracket of this invention allows the inner form to be properly positioned without the use of vertical stakes which penetrate the vapor barrier and optional insulation that customarily underly the floor slab leaving a potential path for seepage of moisture.

The devised spreader bracket 10 cantilevers the inner form member from the outer form member 14 such that the obstacles to an efficient continuous concrete pour are minimized. The outer from member 14 is conventionally positioned and braced utilizing a series of vertical stakes 20 (one shown as an exemplar) each with a supporting diagonal kicker stake 22. One or more stacked form members, here a single board of conventional 2×6 framing lumber, are nailed to the vertical stakes to provide a form for a perimeter wall continuous with the underlying footing.

Figure 3:
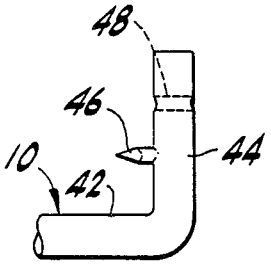
FIG. 3 is an enlarged fragmented view of an end of the spreader bracket.

As shown in FIGS. 1 and 2 the bracket 10 includes a horizontal segment 24 with an end 26 that is inserted through a hole 28 in the outer form member 14. The horizontal segment 24 provides a support for the bottom edge 30 of the vertically oriented inner form member 12, which here comprises a board of conventional 2×4 framing lumber. The horizontal segment bends into a vertical segment 32 which abuts the outside surface 34 of the inner form member 12 and spacially positions the inner form member from the outer form member. The vertical segment 32 includes two holes 36 for nails 38 to fasten the form member 12 to the bracket 10. The vertical segment of the bracket at the top edge 40 of the inner form member bends into a diagonal member 42 which is directed upwardly back toward the outer form member to connect to the vertical stake 20 by a bent end portion 44 with an integral tack pin 46 as shown in the enlarged segmented view of FIG. 3. The bent end portion 44 also includes a nail hole 48 which may be used with a fastening nail in addition to, or in lieu of, the tack pin for securing the bracing end of the bracket to the vertical stake 20 with the end portion 44 hooked around the stake.

The other end 26 of bracket that is inserted through the hole 28 in the outer form member 14 is secured in position by a locking plate 50 which engages a notch 52 in the top of the horizontal segment proximate its end. The locking plate 50 includes a hole 54 through which the bracket end 26 is inserted to engage the plate with the notch. In this manner the bracket is prevented from being pulled through the hole 28 in the form member. To stabilize the bracket and maintain the spacial distance between form members, the locking plate is spun by its wing tabs 56 such that a corner 57 of the plate is wedged between the outer form 14 and its support stake 20 as shown in FIG. 1. Other means may be utilized for fixing the end of the bracket to the outer form.

Figure 4:
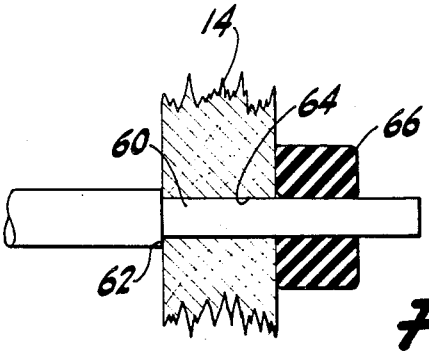
FIG. 4 is an enlarged fragmented view of an alternate end and attachment structure for the spreader bracket.

For example in the alternate embodiment of FIG. 4, a modified horizontal segment 58 has a necked down end portion 60 which provides a shoulder 62 to engage the periphery of a smaller hole 64 through the outer form member 14. The end portion projecting through the form member is frictionally engaged by a rubber ring 66 to hold the bracket in place.

After the concrete has been poured and sufficiently set to remove the inner form member for finish dressing the slab adjacent the stem wall, the brackets are removed by pulling the nails, releasing the plate secured end, and knocking the horizontal segment through the wall. The small hole remaining is easily patched during the dressing operation. Because the brackets and inner form members can be removed with minimal disturbance to the outer form member, they can be removed earlier than is customary, reducing delays and improving the dressing operation.

While the described embodiment of the bracket was configured for standard 2×6 and 2×4 form members, it may clearly be configured for other size materials to accommodate the desired design requirements for a particular sized stem wall to be constructed.

While the spreader bracket was designed primarily for a unitary stem wall and floor slab structure it is suitable for those unitary step structures, such as curbs with aprons, having an upper level and a lower level requiring a form member to provide a riser facing between the upper level and the lower level where it is desirable that stakes or other vertical members not penetrate through the lower level.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. In a concrete form for casting a unitary concrete step structure with an upper level and a lower level, the form having an outer form member with a ground support comprising a vertical stake attached to the outer form member, the outer form member being arranged to provide a wall facing for the upper level, and, an inner form member arranged to provide a riser facing for the upper level and positioned between the upper level and lower lever with the inner form member having a bottom positioned at the lower lever and a top positioned at the upper level, the improvement comprising a removable spreader bracket connected to said supported outer form member and configured to support said inner form member spacially displaced from said outer form member; wherein the bracket comprises a unitary strut having a horizontal segment for supporting the inner form member at the bottom of the inner form member arranged to horizontally pass through the upper level of the step structure at the lower level, a vertical segment connected to the horizontal segment for limiting the spacing of the inner form member from the outer form member, and a diagonal segment connected to the vertical segment for bracing and stabilizing the vertical and horizontal segments, wherein the horizontal segment has an end connected to the supported outer form member and the diagonal segment has an end connected to the vertical stake above the outer form member, and the horizontal and diagonal segments being connected to the vertical segment at opposite ends thereof, whereby on setting of a poured concrete structure, the horizontal segment is detached from the outer form member and tapped through the upper level of the step structure for early removal of the inner form member.

2. The bracket of claim 1 wherein the end of the horizontal member is connected through the outer form member.

3. The bracket of claim 2 wherein the outer form member has a hole through which the end of the horizontal member is inserted, the end of the horizontal member having an attachment means for securing the end of the horizontal member to the form member.

4. The bracket of claim 3 wherein the end of the horizontal member has a notch across the top of the member, the bracket including a locking plate having a hole, said hole having its perimeter engageable with the notch, the plate being attachable to the outer form member.

5. The bracket of claim 4 wherein the plate has a wedge edge and a wing tab for spinning the plate to engage the wedge edge between the stake and outer form.

6. The bracket of claim 5 wherein the diagonal member includes a bent end portion, said bent end portion includes a tack pin engageable with the stake for securing the end portion to the stake.

7. The bracket of claim 5 wherein the diagonal member includes a bent end portion, said bent end portion includes a nail hole and the bracket includes a nail engageable with the stake for securing the bent end portion of the stake.

8. The bracket of claim 1 wherein the vertical segment includes at least one nail hole and at least one nail drivable through the nail hole and engageable with the inner form member for securing the inner form member to the bracket.

9. The bracket of claim 1 wherein the strut is fabricated from a bent steel rod.

10. The bracket of claim 1 wherein the strut is fabricated from a formed plastic.

* * * * *